United States Patent [19]

Brown et al.

[11] 4,222,675

[45] Sep. 16, 1980

[54] LOW PROFILE KEYBOARD OPERATOR

[75] Inventors: Richard W. Brown, Greenwich, Conn.; Lloyd E. Alterton, Sunnyvale; Joseph Eckerle, Redwood City; Brian J. Grossi, Menlo Park; William A. Stephens, Long Beach, all of Calif.

[73] Assignee: Savin Corporation, Valhalla, N.Y.

[21] Appl. No.: 883,916

[22] Filed: Mar. 6, 1978

[51] Int. Cl.[3] ..... B41J 5/08; B41J 29/00

[52] U.S. Cl. ..... 400/474; 400/70; 335/112; 200/175

[58] Field of Search ..... 400/61, 70, 472–474; 200/5 R, 5 E, 175; 335/112, 113; 74/501 P, 501 R

[56] References Cited

U.S. PATENT DOCUMENTS

| | | | |
|---|---|---|---|
| 1,283,174 | 10/1918 | Ghio | 400/70 |
| 1,753,991 | 4/1930 | Langford | 400/474 |
| 2,581,665 | 1/1952 | Jarmann | 400/474 |
| 2,651,682 | 9/1953 | Kinithof | 335/112 |
| 2,666,516 | 1/1954 | Boni | 400/473 |
| 3,374,451 | 3/1968 | Barker et al. | 335/112 |
| 3,427,575 | 2/1969 | Mustafa | 335/112 |
| 3,492,612 | 1/1970 | Ayres et al. | 335/112 |
| 3,629,836 | 12/1971 | Schlesinger, Jr. | 335/112 |
| 3,711,670 | 1/1973 | Dietsch | 200/175 |
| 3,768,622 | 10/1973 | Wood | 400/473 |
| 4,138,197 | 2/1979 | Minton | 400/474 |
| 4,141,658 | 2/1979 | Ricca | 400/474 |
| 4,146,336 | 3/1979 | Hasenbalg | 400/474 |

*Primary Examiner*—William Pieprz
*Attorney, Agent, or Firm*—Shenier & O'Connor

[57] ABSTRACT

A low profile keyboard operating system in which a generally orthogonal matrix of mechanically movable row and column matrix members is disposed over the keyboard to be operated with the intersections of the matrix members adjacent to the keys, the arrangement being such that actuation of only one member at an intersection will not operate a key while operation of both members at an intersection actuates a key.

13 Claims, 24 Drawing Figures

FIG. 2
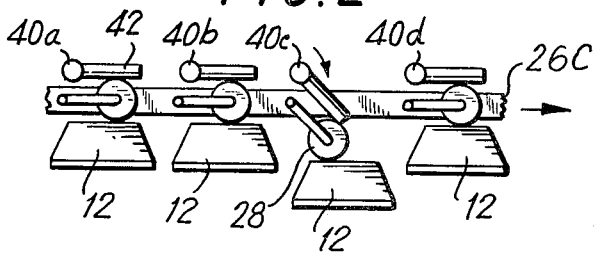
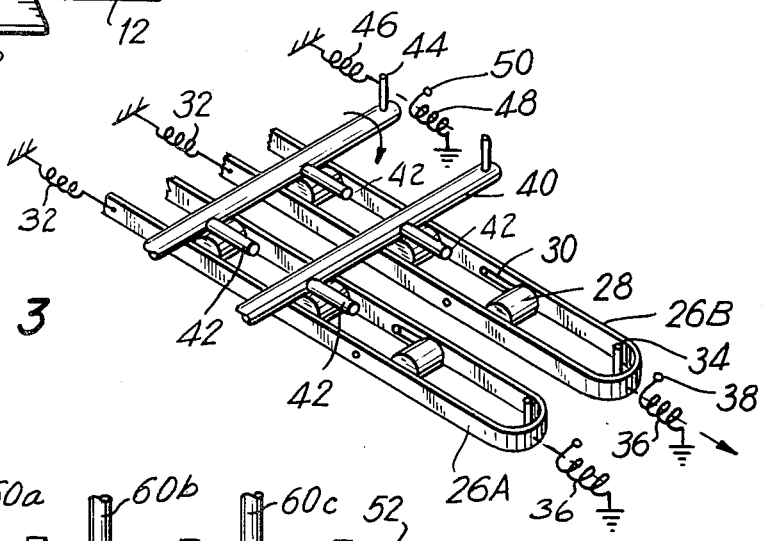
FIG. 3
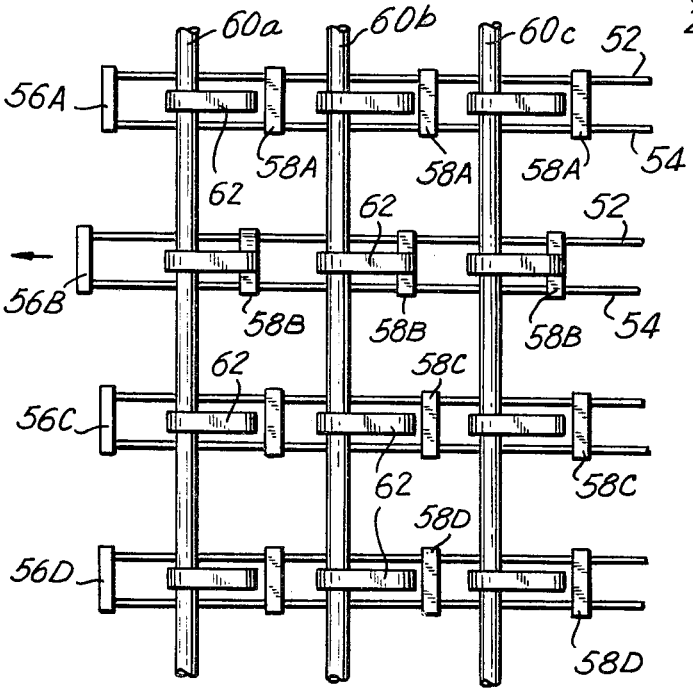
FIG. 4
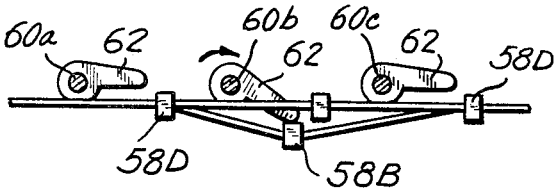
FIG. 5

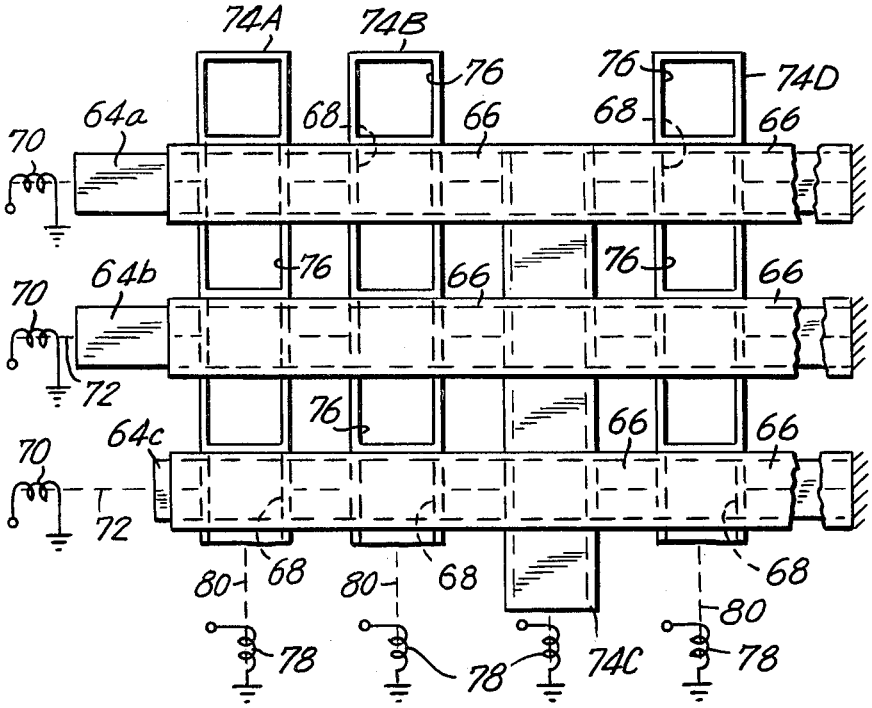
FIG. 6
FIG. 7
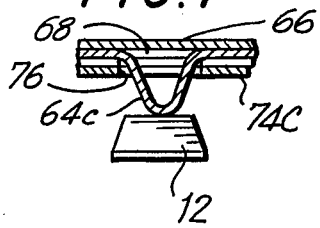
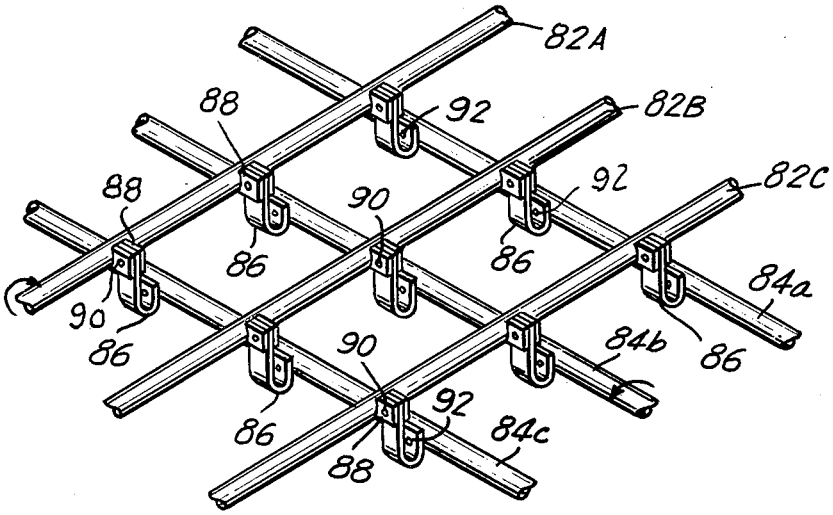
FIG. 8
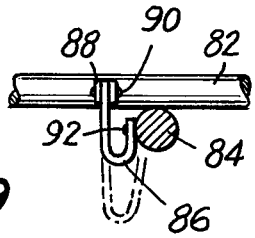
FIG. 9

LOW PROFILE KEYBOARD OPERATOR

BACKGROUND OF THE INVENTION

It is frequently desirable to provide an electromechanical interface between an alphanumeric data line, such as from a computer or a word processor, and a general-purpose keyboard device, such as a typewriter or an adding machine. An example of such an arrangement is shown in Stine U.S. Pat. No. 3,029,919, in which an array of solenoids are arranged with their armature axes extending vertically above the keys of the keyboard, one solenoid for each key. The solenoids are individually actuated in response to signals fed to an electrical matrix. An auxiliary keyboard provided above the solenoid array permits manual operation of the underlying keyboard with the interface remaining in place. Such a system is entirely impractical in that the auxiliary keyboard is so high as to render it practically useless to an operator accustomed to a standard keyboard. In addition the very large number of solenoids required makes the system inordinately expensive.

SUMMARY OF THE INVENTION

One object of our invention is to provide a keyboard actuating system having a low profile.

Another object of our invention is to provide a keyboard actuating system in combination with an auxiliary keyboard which can be used without inconvenience by an operator used to a standard keyboard.

Yet another object of our invention is to provide a low profile keyboard operator which does not require any internal mechanical or electrical connections to the machine with which it is used.

A further object of our invention is to provide a keyboard actuating system which can be placed in operative relationship with and can be removed from an ordinary typewriter keyboard without assembly and disassembly of parts.

Still another object of our invention is to provide a keyboard actuating system which is less expensive to construct than are keyboard operators of the prior art.

Yet another object of our invention is to provide a keyboard actuating system which is simple in construction and operation.

A still further object of our invention is to provide a keyboard actuating system which is certain in operation.

Other and further objects of our invention will appear from the following description.

BRIEF DESCRIPTION OF THE DRAWINGS

In the accompanying drawings to which reference is made in the instant specification and in which like reference characters are used to indicate like parts in the various views:

FIG. 2 is a diagrammatic view of the form of our low profile keyboard operating system illustrated in FIG. 1.

FIG. 3 is a fragmentary perspective of the form of our low profile keyboard operating system illustrated in FIG. 2.

FIG. 4 is a fragmentary top plan of an alternate form of our low profile keyboard operating system.

FIG. 5 is a fragmentary sectional view of the form of our low profile keyboard operating system illustrated in FIG. 4.

FIG. 6 is a fragmentary top plan of a further embodiment of our low profile keyboard operating system.

FIG. 7 is a fragmentary section of the form of our low profile keyboard operating system shown in FIG. 6.

FIG. 8 is a fragmentary perspective of a still further form of our low profile keyboard operating system.

FIG. 9 is a fragmentary perspective illustrating the operation of the form of our low profile keyboard operating system shown in FIG. 8.

DESCRIPTION OF THE PREFERRED EMBODIMENT

Figure 1:
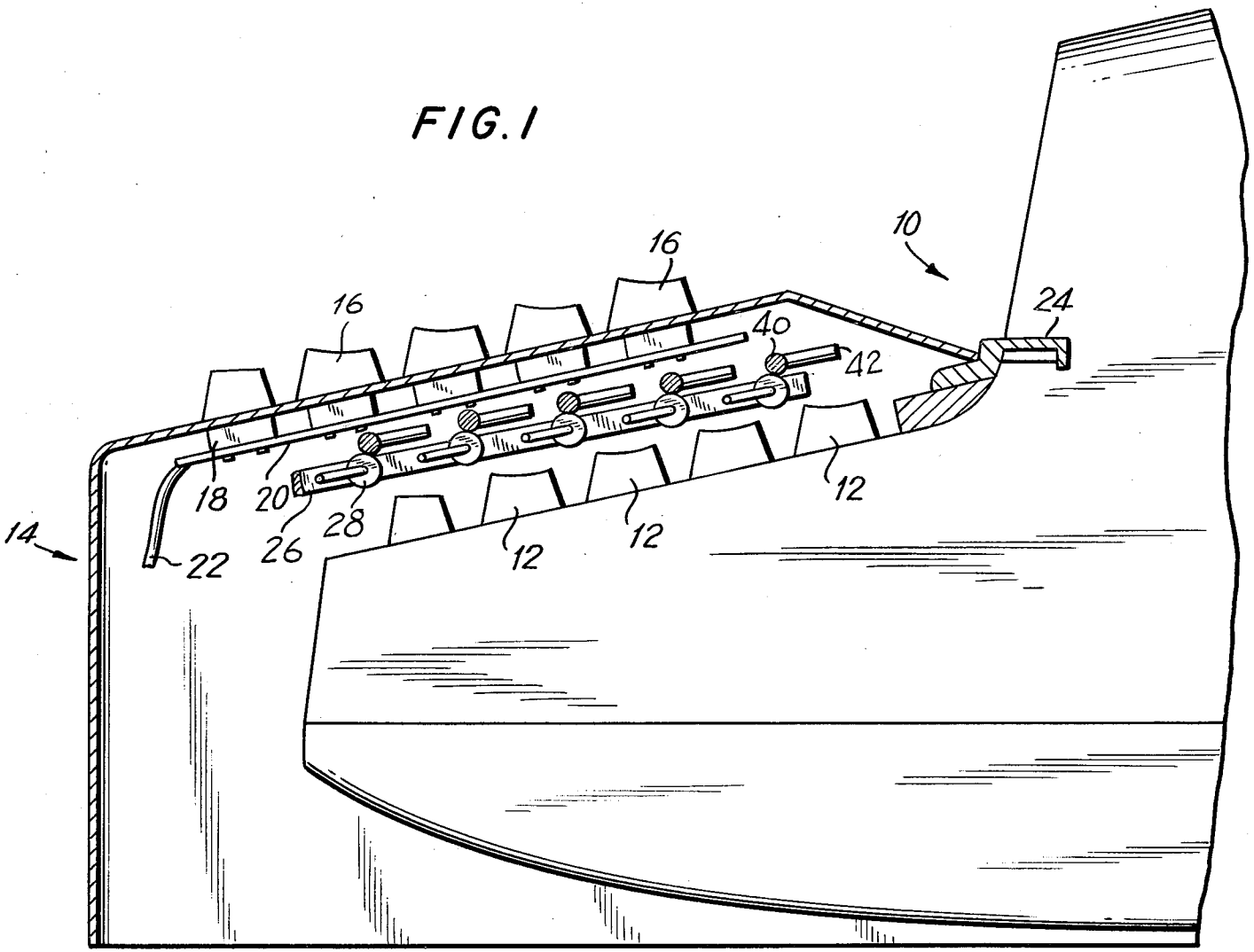
FIG. 1 is a side elevation of a typewriter and auxiliary keyboard associated with one form of our low profile keyboard operating arrangement, with parts shown in section.

Referring now to FIG. 1 of the drawings, our low profile keyboard operating arrangement is adapted to be used with a machine, such for example as a typewriter indicated generally by the reference character 10 having keyboard with a plurality of keys 12. The casing or housing indicated generally by the reference character 14 of our unit supports a plurality of auxiliary keys 16 adapted to be operated to close switches 18 to make certain connections on a printed circuit board 20. A cable 22 may connect the circuit board 20 to a minicomputer (not shown), which may feed signals back directly to our operator to be described to operate the keys 12 or, alternatively, may store information or as a further alternative may be operated independently of the auxiliary keys 16 to put out information signals which cause our operating system to actuate the keys 12 to print out certain information. Since the details of the relationship between the auxiliary keyboard, the minicomputer and our operator are not, per se, a part of our invention, they will not be described in detail. Any suitable means, such for example, as a hanger bracket 24 may be used to position the housing 14 properly with reference to the machine 10, in such a way as to permit the assembly to be placed in operative relationship with and to be removed from the typewriter 10 without disassembly of any parts.

Referring now to FIGS. 2 and 3, one form of our keyboard operator includes a plurality of first matrix members in the form of frames 26A, 26B, and so forth. These frames are supported for sliding movement on the housing 14 in any suitable manner. Each of the frames 26 receives logitudinally spaced pairs of resilient legs 30, each pair of which carries a roller 28 at a predetermined position along the frame 26. The spacing between the respective rollers 28 on a frame 26 may be equal to the spacing between the keys of a column of keys 12 of the machine 10. Respective springs 32 normally urge the frames 26 to positions against stops 34 at which the rollers 28 are out of alignment with the keys with which they are associated. Respective solenoids 36 have terminals 38 to which signals may be applied selectively to move the frames to positions at which the rollers 28 overlie the keys 12 with which they are associated.

From the structure thus far described, it will be appreciated that the frames 26 and their associated structures make up one set of matrix members. They may, for example, be associated with columns of keys 12. It will further be appreciated that as many frames 26 are provided as there are columns of keys to be operated. A plurality of shafts 40A, 40B, 40C, and 40D make up the other set of matrix members. There may, for example, be provided as many shafts 40 as there are rows of keys to be operated by the matrix members. Each of the shafts 40 carries a plurality of spaced arms 42 along the length thereof. As many arms 42 are provided as there are keys to be operated in the row with which the shaft 40 is associated. Any suitable means is provided for positioning shafts 40 in a home position at which the axes of the arms 42 are generally parallel to the plane of the keyboard including the keys 12. By way of example, we have illustrated a spring 46 connected between a pin 44 on the shaft and the housing 14 for achieving this purpose. We provide a solenoid 48 for each of the shafts 40. In response to a signal applied to the terminal 50 of the solenoid 48, the associated shaft rotates through approximately 90°.

In operation of the form of our keyboard operator shown in FIGS. 2 and 3, normally the frames 26 are so positioned that their rollers 28 are out of alignment with the keys 12 with which they are associated. Further, the position of the rollers 28 with relation to the arms 42 is such that rotation of a shaft 40 will not result in actuation of any roller. However, if a signal is applied to the terminal 38 of one of the solenoids 36 the corresponding frame 26 shifts to a position at which the rollers 28 are over the keys 12 with which they are associated and are disposed below the arms 42. Under this condition, if any one of the shafts 40 is rotated, one of the rollers 28 of the frame 26 which has been shifted will be driven by the arm 42 so as to actuate a key 12. By way of illustration in FIG. 2, we have shown operation of a key which results when a signal is applied to the solenoid 36 associated with frame 26C and a signal is applied to the solenoid 48 associated with the shaft 40C. It will further be understood by those skilled in the art that we may employ rotary solenoids to drive the shafts 40 rather than the linear solenoids shown.

Referring now to FIGS. 4 and 5, in an alternate embodiment of our keyboard operator, each of one set of matrix members include a pair of flexible cables 52 and 54 connected at one end by an operator 56. There are as many pairs of cables 52 and 54 as there are columns of keys to be actuated and respective operators 56A, 56B, 56C and so forth are associated with the sets of cables. Spaced along the lengths of the cables 52 and 54 of each pair are tappets 58 with an inter-tappet spacing corresponding to the spacing between a pair of adjacent keys of a column of keys.

Any suitable means such, for example, as the spring and solenoid arrangement of FIGS. 2 and 3 may be employed normally to position a member including cables 52 and 54, so that the tappets 58 thereof are not aligned with the keys with which they are associated. Further, upon energization of a solenoid, the cables of the associated pair are shifted to a position as indicated for row or column B in FIG. 4, at which the tappets 58 are aligned with the keys with which they are associated.

The other set of matrix members in the form of our invention illustrated in FIGS. 4 and 5, includes a plurality of shafts 60*a*, 60*b*, 60*c*, and so forth. Spaced along the length of each of the shafts are rocker arms 62 adjacent ones of which are spaced by the distance between adjacent keys with which the shaft arms are associated. The shafts 60 may be associated with the rows of keys on the keyboard. An arrangement similar to that associated with the shafts 40 in FIG. 3 may be used to actuate shafts 60.

The operation of the form of our system shown in FIG. 4 is generally similar to that shown in FIGS. 2 and 3. For example, if the actuator 56 of one pair of cables 52 and 54 is shifted, its tappets 58 will be positioned over the keys with which they are associated. At the same time, if one of the shafts 60 rotates, it will operate the tappet of the shifted actuator to operate one of the keys. By way of example in FIG. 5, we have illustrated the operator where the shaft 60*b* has been rotated to actuate the tappet 58 associated with the shifted actuator 56B.

Referring now to FIGS. 6 and 7, a third embodiment of our keyboard actuator includes a plurality of flexible tapes, ribbons, or the like, 64*a*, 64*b*, 64*c*, and so forth, which are formed of any suitable flexible metal or plastic. The major portion of each of the ribbons or tapes 64 is received in a housing 66, the underside of which is provided with a plurality of windows 68 at spaced locations corresponding to the spacing between keys with which the tape or ribbon 64 is associated. We provide a solenoid 70 having an armature 72 for each of the respective tapes 64. In response to energization of the solenoid, a force is applied to the associated tape to tend to drive it into the housing. It is to be understood that the portion of each ribbon or tape normally positioned outwardly of its associated housing to the left as viewed in FIG. 6 is stiffened or supported in any suitable manner so that it will not buckle in response to energization of the associated solenoid.

The other group of matrix members in this form of our system is made up of a plurality of generally flat bars 74A, 74B, 74C, 74D, each of which is provided with spaced windows 76 corresponding to the inter-key spacing of the keyboard. The bars 74 normally are positioned so that inter-window portions thereof underlie the windows 68 of the housing 66. However, when one of the bars is shifted to align its windows 68 of the respective housings 66 and one of the solenoids 70 is energized, the ribbon or tape associated with the solenoid 70 which has been energized will buckle or flex outwardly through the aligned windows 68 and 76 and operate a key located therebelow. By way of example, in FIG. 7 we have illustrated the condition which would exist wherein the bar 74C was actuated and the ribbon **64*c*** was driven.

Referring now to FIGS. 8 and 9, the fourth form of our keyboard operating arrangement includes a first plurality of matrix members which are shafts 82A, 82B, and 82C, and so forth, equal in number to the number of rows or columns of the keyboard with which they are associated. The second set of matrix members includes shafts **84*a*, 84*b*, and 84*c*, and so forth, equal in number to the number of rows or columns of the keyboard with which they are associated. Adjacent to each point of intersection of shafts 82 and 84 and on the shafts 82, I mount a clevis 88 having a pin 90 which receives one end of a flexible loop 86. A pin 92 or the like secures the other end of the loop of flexible material 86 to the shaft 84 at a location adjacent to the point of intersection. Again it will readily be appreciated that the flexible loops 86 may be formed of any suitable flexible material, such as metal or plastic, or the like. In response to rotation of one of the shafts 82, through approximately 90°, the bight of each of the loops 86 associated therewith will be displaced downwardly through a distance approximately "x". Similarly, in response to rotation of one of the shafts 84, through approximately 90°, the bight of the loops 86 associated therewith will be moved downwardly through the distance "x". By way of example, in FIG. 8 we have illustrated the result where shaft 82A has been rotated through approximately a quarter revolution and shaft 84B has been rotated through approximately a quarter of a revolution. Under these conditions, the bight of the loop 86 associated with both shafts 82A and 84B will move downwardly through a distance 2x to actuate a key. While the bight of the other loops 86 associated with shafts 82A and 84B move downwardly through a distance x, this is not a sufficient movement to result in operation of a key. The shaft operating solenoid arrangement of FIG. 3 or a rotary solenoid arrangement, may be used to drive the shafts 82 and 84**.

Figure 10:
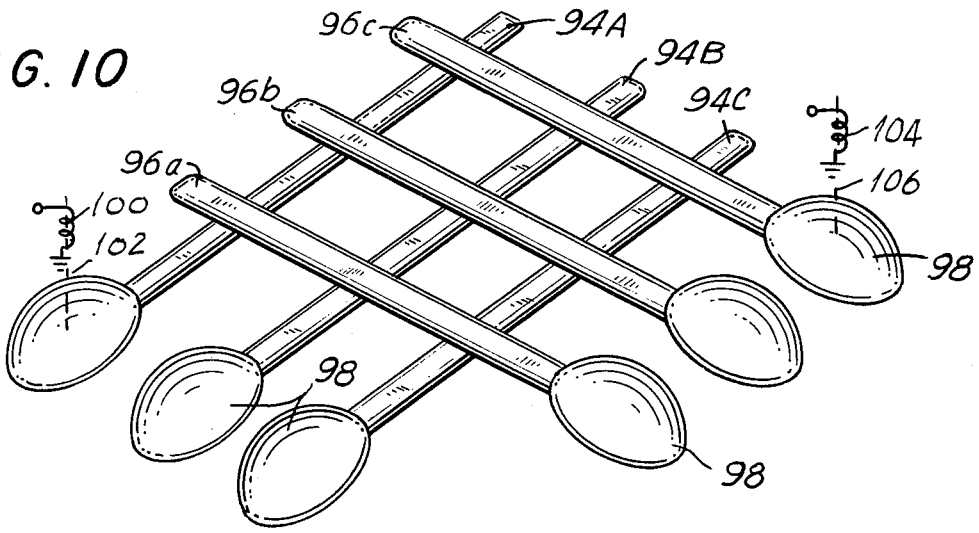
FIG. 10 is a perspective of a still further form of our low profile keyboard operating system.
Figure 11:
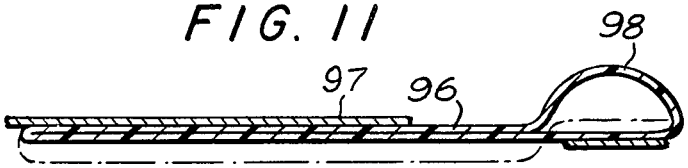
FIG. 11 is a section of one of the elements of the form of our low profile keyboard operating system shown in FIG. 10.
Figure 12:
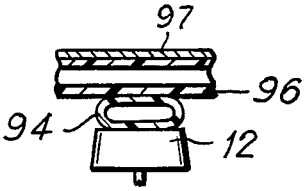
FIG. 12 is a fragmentary section of the form of our low profile keyboard operating system shown in FIG. 10 illustrating the operation of the system at our intersection thereof in actuating a key.

Referring now to FIGS. 10 to 12, the next form of our keyboard actuator includes a first plurality of matrix members 94A, 94B, 94C, and so forth, and a second set of matrix members **96*a*, 96*b*, 96*c*, and so forth, which members are so arranged as to intersect with the point of intersection overlying the keys to be operated. It will readily be appreciated that as many members are provided as are necessary to accommodate the number of keys in the keyboard. Each of the members 94 and 96 is formed from a flexible material so as to provide an elongated portion adapted to be inflated to produce a predetermined vertical displacement at a point of intersection. The arrangement further is such that if a pair of intersecting members are inflated, the aggregate vertical displacement provided at the point of intersection is sufficient to operate a key. In order to cause this result to take place, a board 97, or the like, positioned in the housing 14 provides a surface against which the elements 96 and 94 can react so that the resultant movement is downward as indicated in FIG. 12 to operate the key 12. By way of example, solenoids 100 having armatures 102 may be associated with the bulbous portions 98 of the members 94, while solenoids 104 having armatures 106 may be associated with the bulbous portions 98 of the matrix 96**.

Referring now to FIGS. 13 to 16, in a still further form of our low profile keyboard operator, a plurality of balls 108 are located at the intersections of the matrix. First members 110A, 110B, 110C, and so forth, connect the balls 108 of the respective columns of the matrix. A second set of matrix elements **112*a*, 112*b*, 112*c*, and so forth, connect the balls 108 of the rows of the matrix. These matrix members 110 and 112 may, for example, be strings or the like secured to the balls. We provide as many matrix balls 108** as there are keys to be operated.

Figure 15:
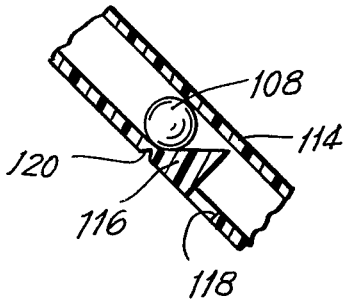
FIG. 15 is a fragmentary section of the form of our keyboard of operating system illustrated in FIG. 13 demonstrating the operation thereof under certain conditions.
Figure 16:
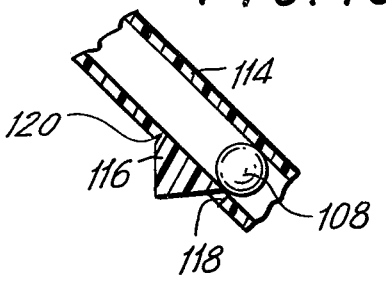
FIG. 16 is a fragmentary section of the form of our keyboard operating system illustrated in FIG. 13 further demonstrating the operation of this form of our system.

The form of our invention illustrated in FIGS. 13 to 16 further includes a plurality of diagonally extending housings 114 provided with respective ramp-like elements 116 as located adjacent to the balls 108. These triangular ramp-like elements are connected to the bases of the housings 114 by hinges 120 which permit the members to move outwardly through openings 118 in the bottoms of the housings 114. Openings 122 in the sides of the housing 114 permit the passage of string matrix members 110 and 112 therethrough. Means such as the solenoids employed in the other forms of our system are respectively energized to pull strings 112 selectively to the right as viewed in FIGS. 13 and 14 and are energized to pull the strings 110 selectively downwardly as viewed in FIGS. 13 and 14. As can be seen by reference to FIG. 14 actuation of a string 112 associated with a ball 108 causes the ball to move to the broken line position in the absence of a concomitant actuation of a string 110. Correspondingly, actuation of a string 110 in the absence of a string 112 causes the ball 108 to move to the dotted line position shown in FIG. 14. In both of these positions, the relationship between the ball and the ramp-like member 116 is as shown in FIG. 15, so that no movement of the member 116 results. However, upon the concomitant operation of a string 110 and a string 112, the ball 108 moves to the dot-dash line position indicated in FIG. 14. In this position of the ball, which is the full line position of the ball shown in FIG. 16, the ramp-like member 116 moves about its hinge 120 to a position out of the housing 114 to operate the key associated therewith. By way of example, in FIG. 13 the ball 108 located at the intersection of string 110C and string **112*c* is shown in the position at which it will actuate its associated ramp element 116** to operate a key.

Figure 13:
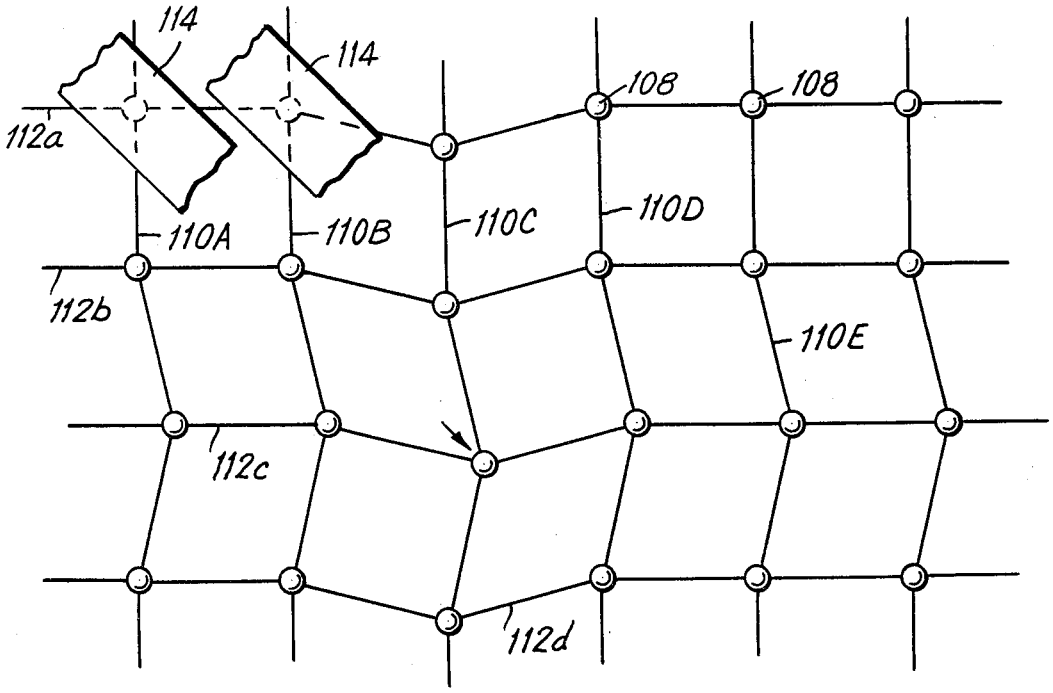
FIG. 13 is a fragmentary plan of yet another form of our low profile keyboard operating system, with parts broken away and with other parts removed.
Figure 14:
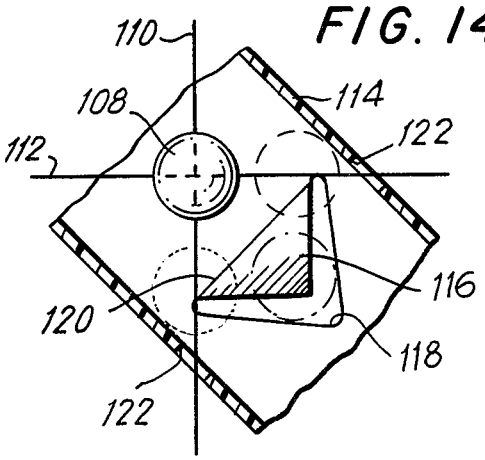
FIG. 14 is a fragmentary section of a portion of the low profile keyboard operating system illustrated in FIG. 13.
Figure 17:
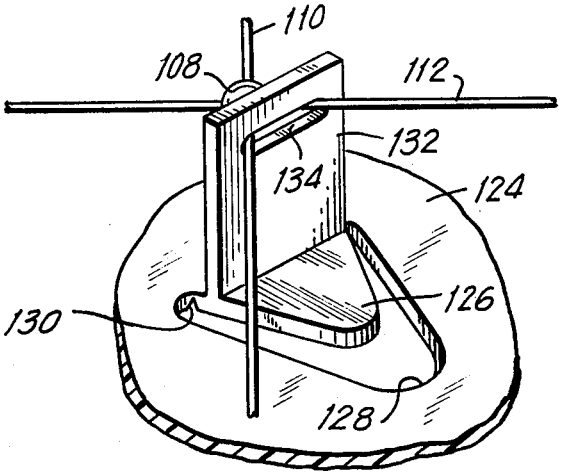
FIG. 17 is a fragmentary perspective of yet another form of our keyboard operating system.
Figure 18:
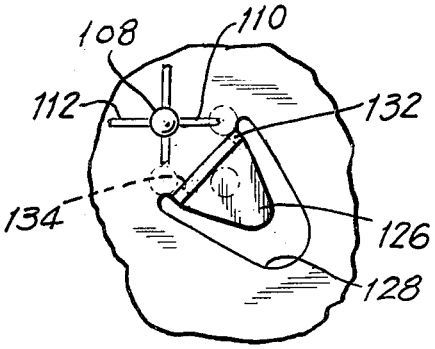
FIG. 18 is a fragmentary top plan of the form of our low profile keyboard operating system illustrated in FIG. 17.

Referring now to FIGS. 17 and 18, the string and ball matrix illustrated in FIG. 13 may be employed with a somewhat different arrangement of operating elements. A plate 124 positioned over the keyboard is formed with a plurality of openings 128 and with key actuating elements 126 supported for movement adjacent to the openings by hinges 130. We provide each of the members 126 with an upstanding flange or tab 132 formed with a lateral slot 134 through which the strings 110 and 112 associated with a ball 108 extend. In response to movement of a string 110 in the absence of actuation of the associated string 112, the ball 108 merely moves toward one end of the slot 134. Similarly, upon the actuation of a member 112 in the absence of actuation of a member 110, the ball merely moves to the other end of the slot 134. Upon concomitant operation of both of the matrix elements 110 and 112, the ball acts on the tab 132 adjacent to the center of the slot 134 to cause the member 126 to swing downwardly around its hinge 130 through a sufficient distance to actuate a key associated therewith.

Referring now to FIGS. 19 through 22, yet another form of our low profile keyboard operator includes a plurality of levers 132 carried by supports 134 which permit pivotal movement of the levers around their fulcrums 134 and further which permit bodily movement downward of the lever and the fulcrum in the course of actuation of a key. It will readily be appreciated that the members 134 might, for example, be resilient. A first set of matrix members 138A, 138B, and 138C are associated with respective solenoids 140 having armatures 142. In response to energization of a solenoid 140 associated with one of the members 138, the member moves upwardly as viewed in FIG. 19 and to the right as viewed in FIG. 21 to cause a cam 144 on the underside of the member to engage one end of the lever 132 to initiate a pivotal movement thereof around its fulcrum 134.

Figure 19:
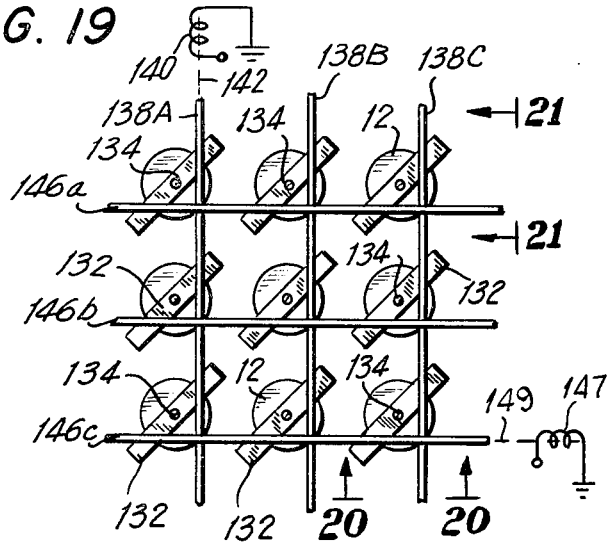
FIG. 19 is a fragmentary plan of a still further form of our low profile keyboard operating system.

A second plurality of rods 146 extending generally perpendicularly to the rods 138 are adapted to be moved to the right as viewed in FIG. 19 in response to energization of a solenoid 147 having an armature 149 connected to the rod. These rods 146 have cams 148 adapted to engage the opposite ends of the levers 132 from the ends which are engaged by the cams 144.

Figure 20:
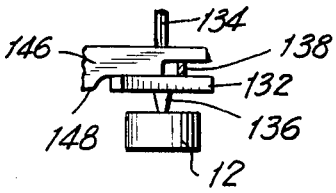
FIG. 20 is a fragmentary elevation of the form of our low profile keyboard operating system illustrated in FIG. 19 and taken along the line 20—20 thereof.
Figure 21:
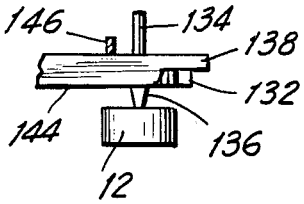
FIG. 21 is a fragmentary elevation of the form of our keyboard operating system illustrated in FIG. 19 taken along the line 21—21 thereof.
Figure 22:
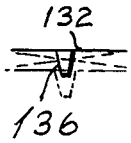
FIG. 22 is a diagrammatic view illustrating the operation of the form of our low profile keyboard operating system illustrated in FIG. 19.

Referring now to FIG. 22, we have diagrammatically indicated the operation of the form of our keyboard operator illustrated in FIGS. 19 to 21. If, for example, a rod 138 is actuated but the corresponding rod 146 is not actuated then the lever 132 tends to pivot around the point at which it engages the underside of the lever 146 as indicated by the broken line in FIG. 22. This will produce a movement "x" downwardly of the fulcrum 136 which is not sufficient to operate the key 12. Correspondingly, if the rod 146 associated with the lever 132 is actuated but the rod 138 is not, then the lever 132 tends to pivot about the portion thereof which engages rod 138 as illustrated by the dotted line in FIG. 22. Again a movement downwardly of the fulcrum 136 of "x" is produced but is not sufficient to cause the key to be operated. When both of the rods 138 and 146 associated with the lever are operated, both ends of the lever move downwardly and the lever does not pivot but its fulcrum moves downwardly through a distance 2x which is sufficient to actuate the key. We have illustrated this position of the lever in dot-dash lines in FIG. 22.

Figure 23:
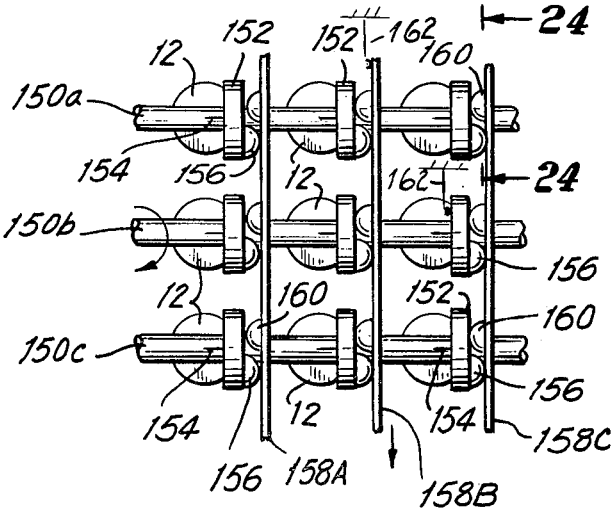
FIG. 23 is a plan of a still further form of our low profile keyboard operating system.
Figure 24:
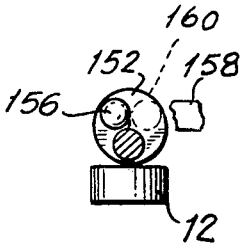
FIG. 24 is a fragmentary elevation of the form of our keyboard operating system illustrated in FIG. 23 with a part broken away.

Referring now to FIGS. 23 and 24, in the last embodiment of our low profile keyboard operator shown in the drawings, a plurality of shafts 150*a*, 150*b*, 150*c*, and so forth, make up one set of the matrix elements. Each shaft 150 loosely supports eccentrics 152 at spaced positions along the shaft corresponding to the spacing between keys to be operated. Respective keys 154 associated with the eccentrics are adapted to receive the eccentrics in a manner to be described, so as to cause them to rotate with the shaft on which they are mounted.

The other matrix members of the form of our system shown in FIGS. 23 and 24 includes a plurality of bars 158A, 158B, and 158C. Each of the bars 158 carries a boss 160 at a location adjacent to each of the eccentrics 152. The eccentrics carry respective bosses 156. As is the case with the other forms of our invention which include shafts, the shafts 150 may be rotated through approximately 90° or more by a means of rotary solenoids or the like against the action of return springs. Similarly, the bars 158 may be moved downwardly as viewed in FIG. 23 in response to the action of solenoids against return springs. Since this structure has been shown in other forms of our invention for purposes of simplicity, it has not been included in FIGS. 23 and 24. We provide leaf spring 162 which normally position the eccentrics out of cooperative relationship with the keys 152.

In operation of the form of our invention illustrated in FIGS. 23 and 24, one of the bars 158 is moved downwardly to bring all of the associated eccentrics 152 into operative relationship with keys 154 against the action of return springs 162. Next, one of the shafts, such for example, as shaft 158B is driven through approximately a half of a revolution to cause the eccentric to move the associated key 12 downwardly through a distance sufficient to operate the key.

In use of our low profile keyboard operating system in conjunction with a typewriter 10, for example, the hanger bracket 24 so engages the frame of the typewriter as to position the key operating elements of the matrix in each form of our invention at locations at which they can operate the keys 12 of the matrix when the matrix members at a point of intersection are operated. Our arrangement has a very low profile so that the keys 16 of the auxiliary keyboard are not far displaced from corresponding keys 12 of the main keyboard. For example, in a particular embodiment of our invention, the distance between the upper edges of the keys 16 in the plane of the upper keyboard and the upper edges of the keys 12 in the plane of the main keyboard is approximately an inch and a quarter. Moreover, the front of the housing 14 is only approximately an inch and a half from the front of the machine 10. Thus, the auxiliary keys are so positioned as to be relatively easily operated by an operator accustomed to the location of the conventional keyboard. It will be seen in addition that our keyboard operating system does not require any auxiliary mechanical or electrical connections to be made inside of the machine 10. The operation of the various forms of our keyboard operating system will readily be apparent from the description hereinabove.

It will be seen that we have accomplished the objects of our invention. We have provided a keyboard actuating system which has a low profile. Our keyboard actuating system is especially adapted for use in combination with an auxiliary keyboard which can be used without inconvenience by an operator used to a standard keyboard. Our keyboard operator does not require any internal mechanical or electrical connections to the machine with which it is used. It can readily manually be placed in operative relationship with and be removed from an ordinary typewriter without assembly and disassembly of parts. Our keyboard actuating system is less expensive to construct than keyboard operators of the prior art. It is simple in construction and operation.

It will be understood that certain features and subcombinations are of utility and may be employed without reference to other features and subcombinations. This is contemplated by and is within the scope of our claims. It is further obvious that various changes may be made in details within the scope of our claims without departing from the spirit of our invention. It is, therefore, to be understood that our invention is not to be limited to the specific details shown and described.

Having thus described our invention, what we claim is:

1. An operating system for a keyboard having a plurality of keys to be operated including in combination, a plurality of first matrix forming means, each of said first matrix forming means comprising a shaft mounted for rotary movement from a home position to an active position and a plurality of crank arms carried by said shaft for rotation therewith at locations therealong spaced by a distance approximating equal to the interkey spacing of said keyboard, a plurality of second matrix forming means, each of said second matrix forming means comprising a member movable relative to said shafts and a plurality of second elements carried by said member at spaced locations therealong corresponding to the interkey spacing of said keyboard, means mounting said first and second matrix forming means in cooperative relationship to form a generally planar matrix the points of intersection of which are adapted to be positioned adjacent to keyboard keys when said system is placed in operative relationship with a keyboard, means for moving one of said members to bring the second elements carried thereby into cooperative relationship with crank arms carried by the respective shafts adjacent to said points of intersection and means for rotating one of said shafts from its home position to its active position, the construction and arrangement of said elements being such that concomitant movement of one of said members and rotation of one of said shafts causes one of said crank arms to displace one of said second elements in a direction generally perpendicular to the plane of said matrix adjacent to the point of intersection of said one member and said one shaft through a distance sufficient to operate a key of said keyboard, each of said members comprising a frame, said second elements comprising a plurality of rollers, means mounting said rollers on said frame for swinging movement with an interroller spacing approximately equal to said keyboard interkey spacing, and means supporting said frame for movement between a first position at which said rollers are out of the path of movement of said arms and a second position at which said rollers are in the path of said arms.

2. An operating system as in claim 1 in which said roller mounting means comprises means for biasing said rollers to home positions on said frame.

3. A keyboard actuating system for actuating the keys of keyboard comprising matrix means including a plurality of loops of flexible material, and means positioning said loops with the bights thereof over the keys of said keyboard, the bight of each loop being movable between a relatively retracted position and a relatively extended position at which it engages one of said keys, said flexible material having sufficient rigidity to operate one of said keys in response to movement of a bight from its retracted to its extended position, and means for actuating said matrix means to move one of said bights from its retracted to its extended position.

4. A keyboard actuating system as in claim 3 in which said matrix means comprises a plurality of first shafts, a plurality of second shafts, means mounting said first and second shafts in intersecting relationship, means connecting one end of each loop to a first shaft adjacent to a point of intersection, means connecting the other end of each loop to a second shaft adjacent to form a a bight, the arrangement being such that rotation of only one shaft at a point of intersection produces a displacement of said bight which is insufficient to actuate a key and concomitant rotation of both shafts at a point of intersection produces a displacement of said bight which is sufficient to actuate a key.

5. A keyboard operating system including in combination a plurality of first elongated inflatable members, a plurality of second elongated inflatable members, means mounting said first and second members in superposed intersecting relationship with the points of intersection forming a pattern corresponding to the pattern of the keyboard keys to be actuated and means for individually and selectively inflating said members, the arrangement being such that inflation of only one member at a point of intersection produces a displacement which is insufficient to actuate a keyboard key while concomitant inflation of both members at a point of intersection produces sufficient displacement to actuate a keyboard key.

6. A keyboard operating system as in claim 5 in which each of said inflating means comprises a bulbous portion at the end of a member to form a gas-filled chamber and means for squeezing said bulbous portion.

7. A keyboard operating system including in combination an array of balls normally positioned in a configuration of rows and columns corresponding generally to the keys of a keyboard, respective first string means for moving said rows of balls in one direction, second string means for moving said columns of balls in a second direction and means responsive to a ball motion resulting from concomitant actuation of a first string means and a second string means for actuating a key.

8. A keyboard operating system as in claim 7 in which said means responsive to said resulting ball movement comprises a plurality of ball movement confining means for constraining said balls to move in the plane of said string means, an element mounted for pivotal movement on said constraining means, said element providing a ramp in the path of said resulting movement of said ball to cause said element to pivot to actuate a keyboard key positioned adjacent thereto.

9. A keyboard actuating system as in claim 7 in which said means responsive to said resulting ball movement comprises a support, a key actuating element, means mounting said key actuating element for pivotal movement on said support, an upright tab on said element, a laterally extending slot in said tab, said first and second string means connected to the ball associated with said element extending through said slot.

10. A keyboard operating system including in combination a plurality of shafts, means mounting said shafts with the longitudinal axes thereof extending in the direction of the rows or columns of the keyboard keys, a plurality of cam elements means mounting said cam elements on said shafts at locations adjacent to the locations of keyboard keys with which said system is associated and for movement axially of said shafts between home positions at which the cams can rotate relative to the shafts and active positions at which said cams rotate with said shafts, a plurality of rods extending in the direction of columns or rows of said keys, each of said rods being shiftable between a home position and an active position and interengageable means on said rods and on said cam elements responsive to shifting of a rod for coupling the cam elements associated with a column or row of keyboard keys to their associated shafts.

11. A keyboard actuating system for actuating the keys of a keyboard including in combination a plurality of first shafts, means mounting said first shafts for rotary movement around generally parallel axes, a plurality of second shafts, means mounting said second shafts for rotary movement around second axes disposed at an angle to said first axes to form a matrix the points of intersection of which shafts are disposed adjacent to the respective keys of said keyboard, and means responsive to concomitant rotary movement of one of each of said first and second shafts for actuating the key adjacent to the point of intersection of said axes of said shafts.

12. A keyboard actuating system for actuating the keys of a keyboard comprising matrix means including a plurality of elongated stationary housings, each having spaced windows along the length thereof, a plurality of lengths of flexible material recieved in said housings, each adapted to have a force applied thereto to cause the length to tend to buckle, a plurality of elongated bars having spaced openings therealong, means mounting said bars in intersecting relationship with said housings and each for movement between a home position at which inter-opening spaces of said bars block said windows and an actuated position at which said openings register with said windows, the arrangement being such that upon the concomitant registering of a window with an opening and the application of a force to the flexible length at the registering window the length buckles out through the registering opening and window to form a loop having a bight depth sufficient to actuate a keyboard key.

13. An operating system for a keyboard having a plurality of keys to be operated including in combination, a plurality of first matrix forming means, each of said first matrix forming means comprising a shaft mounted for rotary movement from a home position to an active position and a plurality of crank arms carried by said shaft for rotation therewith at locations therealong spaced by a distance approximately equal to the interkey spacing of said keyboard, a plurality of second matrix forming means, each of said second matrix forming means comprising a member movable relative to said shafts and a plurality of second elements carried by said member at spaced locations therealong corresponding to the interkey spacing of said keyboard, means mounting said first and second matrix forming means in cooperative relationship to form a generally planar matrix the points of intersection of which are adapted to be positioned adjacent to keyboard keys when said system is placed in operative relationship with a keyboard, means for moving one of said members to bring the second elements carried thereby into cooperative relationship with crank arms carried by the respective shafts adjacent to said points of intersection and means for rotating one of said shafts from its home position to its active position, the construction and arrangement of said elements being such that concomitant movement of one of said members and rotation of one of said shafts causes one of said crank arms to displace one of said second elements in a direction generally perpendicular to the plane of said matrix adjacent to the point of intersection of said one member and said one shaft through a distance sufficient to operate a key of said keyboard, said second elements comprising a plurality of tappets, said members mounting said tappets in spaced relationship with an intertappet spacing approximating a keyboard interkey spacing, means supporting said members for movement between a first position at which said tappets are out of the path of movement of said arms and second positions at which said tappets are in the path of movement of said arms, said tappet mounting members comprising resilient cords.

* * * * *